United States Patent [19]

Kobayashi et al.

[11] Patent Number: 4,551,211

[45] Date of Patent: Nov. 5, 1985

[54] AQUEOUS ANODIZING SOLUTION AND PROCESS FOR COLORING ARTICLE OF MAGNESIUM OR MAGNESIUM-BASE ALLOY

[75] Inventors: Waichi Kobayashi; Satoru Takahata, both of Ube, Japan

[73] Assignee: UBE Industries, Ltd., Ube, Japan

[21] Appl. No.: 631,577

[22] Filed: Jul. 17, 1984

[30] Foreign Application Priority Data

Jul. 19, 1983 [JP] Japan ..... 58-131690
Aug. 12, 1983 [JP] Japan ..... 58-148495

[51] Int. Cl.[4] ..... C25D 5/50

[52] U.S. Cl. ..... 204/37.6; 204/564; 148/6.1

[58] Field of Search ..... 148/6.27, 6.1, 6.24; 204/56

[56] References Cited

U.S. PATENT DOCUMENTS 2,364,964 12/1944 Frasch ..... 204/56 M
2,723,952 11/1955 Evangelides ..... 204/56 M
3,395,027 7/1968 Klotz ..... 148/6.27
3,891,517 6/1975 Yanagada ..... 148/6.27

FOREIGN PATENT DOCUMENTS 120723 12/1945 Australia ..... 204/56 M
543726 8/1941 United Kingdom ..... 205/56 M

*Primary Examiner*—Sam Silverberg
*Attorney, Agent, or Firm*—Frishauf, Holtz, Goodman & Woodward

[57] ABSTRACT

An aqueous anodizing solution for anodizing an article of magnesium or magnesium-base alloy which contains, per one liter volume thereof, 20–300 g. of an aluminate, 0.5–8 moles of an alkali hydroxide per one mole of the aluminate, and at least one kind selected from the group consisting of 20–200 g. of a boron compound, 2–50 ml. of a phenol, 2–50 g. of a sulfate, and 5–70 g. of an iodine compound. A process for coloring an article of magnesium or magnesium-base alloy which comprises forming an aluminum oxide-containing layer over a surface of said article and subsequently coloring said layer with an anodized aluminum-coloring dye is also disclosed.

9 Claims, No Drawings

AQUEOUS ANODIZING SOLUTION AND PROCESS FOR COLORING ARTICLE OF MAGNESIUM OR MAGNESIUM-BASE ALLOY

BACKGROUND OF THE INVENTION

1. Field of the Invention

This invention relates to an aqueous anodizing solution for anodizing an article of magnesium or magnesium-base alloy to provide the surface of the article with corrosion resistance, abrasion resistance, and ornamentality. This invention further relates to a process for coloring an article of magnesium or magnesium-base alloy.

2. Description of Prior Arts

Magnesium and magnesium-base alloy are light in weight and favorable in the mechanical characteristics. However, magnesium and magnesium-base alloy are chemically active so that these are readily corroded. For this reason, an article of magnesium or magnesium alloy is generally employed after having been subjected to a certain surface treatment to make it anti-corrosive. Heretofore, various surface treatments have been proposed and some of them have been actually employed.

The known surface treatments for magnesium and magnesium-base alloy are broadly divided into two groups, namely, a chemical conversion and an anodic oxidation.

Representative examples of the chemical conversion include processes described in JIS (Japanese Industrial Standard) H 8651(1978) at Groups 1 to 4, and Group 7. Representative examples of the anodic oxidation include processes described in JIS H 8651(1978) at Groups 5 and 6 (formulation of the anodizing solution of Group 5: ammonium nitrate, sodium bichromate and aqueous ammonia, and formulation of the anodizing solution of Group 6: sodium hydroxide, ethylene glycol, sodium oxalate, sodium bichromate and acidic sodium fluoride); HAE process described in MIL Standard (MIL-M-45202B, formulation of the anodizing solution: potassium hydroxide, potassium fluoride, sodium phosphate, aluminum hydroxide, and potassium permanganate); and Dow-17 process (formulation of the anodizing solution: ammonium hydrogenfluoride, sodium bichromate, and phosphoric acid).

The above-described conventional processes, however, all have disadvantageous features. For instance, although the chemical conversion process is simple in its procedure, the converted surface of an article of magnesium or magnesium-base alloy does not have sufficient corrosion resistance. Thus, the chemical conversion is employed simply for tentative anti-corrosive treatment.

In contrast, the anodic oxidation is generally employed for a long-term anti-corrosive treatement. Among the known anodic oxidation processes, the HAE process and Dow-17 process are effective to impart to the metal surface high corrosion resistance. Nevertheless, improvements are still desired in the processes particularly in the aspects of level of corrosion resistance and ornamentality of the article provided thereby. Moreover, these processes have disadvantageous features in that the surface of an article of magnesium or magnesium-base alloy is automatically colored to show dark brown or dark green face. Although the magnesium or magnesium-base alloy article thus colored in the corrosion inhibiting treatment shows no substantial problem as far as chemical and physical properties are concerned, said article is not willingly accepted as material of commercial goods. More in detail, the article of magnesium or magnesium-base alloy is incorporated into commercial goods generally upon having been colored on the surface to match with the object of the goods to enhance the ornamental or decorative image thereof. The originally dark-colored surface is difficultly colored to show an optional color or an optional hue even though a chemical or electrochemical coloring method is or a painting method applied to the surface.

For obviating the above-described problem, Japanese Patent Provisional Publication 55(1980)-76094 proposes a process for coloring a surface of an article of magnesium or magnesium-base alloy, which comprises a step of treating said surface through an electrolytic treatment (anodic oxidation) in an alkaline electrolytic bath containing trisodium phosphate and an organic acid (or an inorganic acid) or a salt thereof and a subsequent step of coloring the so treated surface of the article with a dye for coloring aluminum (i.e., anodized aluminum-coloring dye). This process, however, requires an additional decolorization-preventing process for keeping the dye on the surface. Therefore, this process still has a disadvantageous feature that the procedures are complicated.

SUMMARY OF THE INVENTION

A primary object of the present invention is to provide an anodizing solution for anodizing an article of magnesium or magnesium-base alloy.

Another object of the invention is to provide an anodizing solution for imparting high corrosion resistance, high abrasion resistance, and excellent ornamentality to an article of magnesium or magnesium-base alloy.

A further object of the invention is to provide a process for coloring an article of magnesium or magnesium-base alloy, the process further imparting high corrosion resistance and excellent ornamentality to an article of magnesium or magnesium-base alloy.

The present invention provides an aqueous anodizing solution for anodizing an article of magnesium or magnesium-base alloy which contains, per one liter volume thereof, 20–300 g. of an aluminate, 0.5–8 moles of an alkali hydroxide per one mole of the aluminate, and at least one kind selected from the group consisting of 20–200 g. of a boron compound, 2–50 ml. of a phenol, 2–50 g. of a sulfate, and 5–70 g. of an iodine compound.

The present invention further provides a process for coloring an article of magnesium or magnesium-base alloy which comprises forming an aluminum oxide-containing layer over a surface of the article and coloring said layer with an anodized aluminum-coloring dye.

An article of magnesium or magnesium-base alloy forms an aluminum oxide-containing layer over the surface thereof upon anodic oxidation in the aqueous anodizing solution of the present invention. Said aluminum oxide-containing layer generally consists essentially of a chemically stable and prominently hard spinel compound ($MgO.Al_2O_3$). Such spinel layer can be formed to have a thickness up to approx. 70 $\mu$m. The spinel layer shows a white surface, and the article of magnesium or magnesium-base alloy whose surface is coated with the spinel layer is remarkably resistant to corrosion and abrasion.

Moreover, it has been discovered that the white surface layer consisting essentially of the spinel compound is easily colored in a dyeing bath containing an anodized aluminum-coloring dye to show an optional color with an optional hue. Moreover, the dye is strongly adsorbed by the surface of the layer, and the so colored layer is highly resistant to decolorization.

DETAILED DESCRIPTION OF THE INVENTION

The aqueous anodizing solution provided by the present invention contains as principal components an aluminate and an alkali hydroxide, and in contrast to the previously known anodizing solutions, does not require incorporation of a heavy metal such as chromium or manganese or a fluorine-containing component. Accordingly, the anodizing solution of the present invention is advantageous in that the waste liquid derived from the anodizing solution is easily treated.

If desired, however, the anodizing solution of the present invention can contain a bichromate so that particularly high corrosion resistance can be imparted to the anodized surface of an article of magnesium or magnesium-base alloy. In this case, the chromate component is necessarily subjected to a specific processing.

The aluminate incorporated into the anodizing solution of the invention preferably is water-soluble, and representative examples include alkali metal salts of aluminic acid such as sodium aluminate and potassium aluminate. The aluminate is contained in an amount of 20–300 g. (preferably 30–250 g.) per one liter volume of the anodizing solution. If the amount of the aluminate is less than the lower limit, an appropriate corrosion-resistant layer such as a spinel layer is not formed on the surface of the article of magnesium or magnesium-base alloy. If the amount of the aluminate exceeds the upper limit, the aluminic acid compound readily decomposes in the solution to produce a precipitate of aluminum hydroxide.

The alkali hydroxide incorporated into the anodizing solution of the present invention is effective to prevent hydrolysis of an aluminic ion which is introduced thereinto in the form of the aluminate. Accordingly, the amount of the alkali hydroxide is closely relative to the content of the aluminic acid ion in the solution. Generally, the amount of the alkali hydroxide ranges from 0.5 to 8 moles (preferably from 1 to 6 moles) per one mole of the aluminate. If the amount of the alkali hydroxide is less than the lower limit, aluminum hydroxide is apt to precipitate. If the amount of the alkali hydroxide exceeds the upper limit, the anodized surface of the article of magnesium or magnesium-base alloy is apt to deteriorate particularly in the corrosion resistance. Representative examples of the alkali hydroxide include sodium hydroxide and potassium hydroxide.

The aqueous anodizing solution of the invention can be prepared by dissolving an aluminate, an alkali hydroxide, and at least one compound selected from the group consisting of a boron compound, a phenol, a sulfate and an iodine compound in the specified amounts. However, since the aluminate can be produced by dissolving metallic aluminum or other aluminum compound such as aluminum hydroxide in an aqueous solution of an alkali hydroxide such as sodium hydroxide or potassium hydroxide, the aqueous anodizing solution can be prepared by employing the aluminum hydroxide or metallic aluminum in place of the aluminate. Accordingly, thus prepared anodizing solution is also included in the aqueous anodizing solution of the invention.

There is no specific limitation on the sequence of adding the aluminate and alkali hydroxide to water. However, in the case that metallic aluminum or aluminum hydroxide is employed in place of the aluminate, the aluminum or aluminum hydroxide is dissolved preferably in a beforehand prepared aqueous alkali hydroxide solution. It is appropriate that other additives are subsequently introduced into the solution. The water to be employed in the preparation of the anodizing solution preferably contains no chloride ion.

As described hereinbefore, the aqueous anodizing solution of the present invention further contains at least one compound selected from the group consisting of a boron compound, a phenol, a sulfate and an iodine compound in the specific amounts. By the use of the so formulated anodizing solution, a treated surface of a magnesium or magnesium-base alloy article shows prominent improvements in the corrosion resistance, abrasion resistance and uniformity of the surface layer.

The boron compound ought to be soluble in water. The introduction of the boron compound into the anodizing solution serves for prominently improving the corrosion resistance of the anodized article. The amount of the boron compound is preferably limited to a certain extent so that no insolubles may remain as well as no precipitate may be produced. Generally, the addition amount of the boron compound ranges from 20 to 200 g/l (based on the whole amount of the prepared anodizing solution, this basis being applied to the following description on the addition amount, unless otherwise indicated). Examples of the boron compound employable in the present invention include potassium methaborate, sodium methaborate, ammonium methaborate, methaboric acid and sodium tetraborate.

The phenol employable in the invention ought to be soluble in the solution and to be inert to other components in the solution so that no precipitate may be produced through reaction. Examples of the phenol include phenol, phenol sodium, phenol-2,4-disulfonic acid, o-phenolsulfonic acid, and p-phenolsulfonic acid. The addition amount of the phenol ranges from 2 to 50 ml/l, preferably ranges from 2 to 25 ml/l. If the addition amount of the phenol is smaller than the lower limit, no noticeable effect is introduced. If the addition amount of the phenol exceeds the above-mentioned upper limit, the electric current is apt to disadvantageously concentrate into a narrow area in the anodic oxidation process so as to fail in obtaining a satisfactory anodized layer.

The sulfate is preferably soluble in the anodizing solution, and is preferably inert to other components in the solution so that no precipitate may be produced by reaction. Examples of such sulfate include sodium sulfate, potassium sulfate and ammonium sulfate. The addition amount of the sulfate ranges from 2 to 50 g/l, preferably ranges from 2 to 25 g/l. If the addition amount of the sulfate is smaller than the lower limit, no noticeable effect of improvement in the corrosion resistance is introduced. If the addition amount of the sulfate exceeds the above-mentioned upper limit, the electric current is apt to disadvantageously increase in the anodic oxidation process so as to fail in obtaining a satisfactory anodized layer.

The iodine compound is preferably soluble in the anodizing solution, and is preferably inert to other components in the solution so that no precipitate may be produced by reaction. Examples of such iodine compound include salts of iodine with alkali metals (e.g., sodium and potassium) and an ammonium salt of iodine. The addition amount of the iodine compound ranges from 5 to 70 g/l, preferably ranges from 5 to 50 g/l. If the addition amount of the iodine compound is smaller than the lower limit, no noticeable effect is introduced. If the addition amount of the iodine compound exceeds the above-mentioned upper limit, the electric current is apt to disadvantageously increase in the anodic oxidation process so as to fail in obtaining a satisfactory anodized layer.

The above-mentioned additives can be incorporated singly or in combination into the anodizing solution of the invention. A combination of the boron compound and iodine compound is preferably employed.

Moreover, the above-mentioned additives can be employed in conbination with a carboxylate. The employable carboxylate is preferably water soluble. Examples of the carboxylate include alkali metal salts (e.g., sodium salt and potassium salt) and ammonium salt of various carboxylic acids such as monocarboxylic acids (e.g., formic acid, acetic acid, propionic acid, and valeic acid), dicarboxylic acids (e.g., oxalic acid, malonic acid, succinic acid, and adipic acid), and oxycarboxylic acids (e.g., lactic acid, tartaric acid, and citric acid). The addition amount of the carboxylate ranges from 2 to 80 g/l, preferably ranges from 5 to 60 g/l. If the addition amount of the carboxylate is less than the lower limit, no noticeable effect is introduced. If the addition amount of the carboxylate exceeds the above-mentioned upper limit, it is apt to fail in obtaining an anodized layer with satisfactory surface.

The anodizing solution of the invention may contain an appropriate chromate in addition to the above-stated additive(s). By the employment of the chromate, the anodizing solution is made more effective to impart corrosion resistance to the surface of the magnesium or magnesium-base alloy article. The chromate is preferably soluble in the anodizing solution, and is preferably inert to other components in the solution so that no precipitate may be produced by reaction. Examples of such chromate include bichromates such as potassium bichromate, sodium bichromate and ammonium bichromate. The addition amount of the chromate ranges from 2 to 100 g/l, preferably ranges from 5 to 50 g/l. If the addition amount of the chromate is less than the lower limit, no noticeable effect is introduced. If the addition amount of the chromate exceeds the above-mentioned upper limit, it is apt to fail in obtaining an anodized layer with satisfactory surface.

There is no specific limitation on the article of magnesium or magnesium-base alloy to which the anodic oxidation using the anodizing solution of the invention is applicable. The magnesium or magnesium-base alloy preferably contains not less than approx. 70% by weight of magnesium. The anodic oxidation using the the anodizing solution of the invention is advantageously applicable to magnesium-base alloys containing one or more other elements such as aluminum, zinc, manganese, zirconium, silicon, and rare earth metals.

In carrying out the anodic oxidation of a magnesium or magnesium-base alloy article in the anodizing solution of the invention, the anodizing solution is preferably maintained at a temperature between 5° and 70° C. If the temperature of the solution is set too low, the process requires larger cooling device which is disadvantageous from the economical viewpoints. On the other hand, if the temperature is set too high, the solution fastly evaporates to make it difficult to maintain the composition of the solution. Accordingly, the temperature of the anodizing solution is advantageously set within the above-mentioned range.

The voltage for the anodic oxidation process is preferably adjusted within a range of 10–150 V, because too low voltage is not effective to form a satisfactory spinel layer on the surface of the magnesium or magnesium-base alloy article, while too high voltage causes violent anodic oxidation reaction on a part of the surface to give burning on the resulting layer. The current density is advantageously adjusted within a range of 0.5–10 $A/dm^2$. The anodizing period is generally adjusted within 10–90 min., depending upon the desired thickness of the surface layer.

The article of magnesium or magnesium-base alloy anodized using the anodizing solution of the invention is then washed with water and dried. Alternatively, the anodized article is washed with water, sealed on the surface in a conventional manner, washed with water, and dried. Thus, an article having a surface layer which is improved in corrosion resistance and abrasion resistance is obtained. The resulting surface layer consists essentially of anodic oxidation product of magnesium or magnesium-base alloy in the presence of the aluminate, and the oxidation product generally is spinel ($MgO.Al_2O_3$) or a mixture containing the spinel. The spinel layer formed in the anodizing solution of the invention adheres to the article to an extent being equal to or higher than an anodic oxidation product layer formed using a conventional anodizing solution. Accordingly, the anodizing solution of the invention can be advantageously employed for the formation of a substrate layer on an article of magnesium or magnesium-base alloy.

The white anodized surface layer formed on an article of magnesium or magnesium-base alloy using the anodizing solution of the invention can be readily colored to an optional color and hue using an (anodized) aluminum-coloring dye which is generally employed in coloring an anodized layer of an aluminum article.

If a surface layer such as magnesium hydroxide [$Mg(OH)_2$], magnesium fluoride [$MgF_2$], or magnesium oxide [MgO] is formed as a white surface layer on the surface of a magnesium or magnesium-base alloy article, it is possible to color the white surface layer using the aluminum-coloring dye. However, even in such case, the adsorbed dye is readily removed by rubbing the colored surface against a white paper sheet, etc., probably because no aluminum component is incorporated into these layers. It is assumed that the aluminum-containing surface layer such as the spinel ($MgO.Al_2O_3$) layer provided by the use of the anodizing solution of the invention reacts chemically with the dye to fix the dye to the surface of the layer so that satisfactory colorization substantially free from decolorization is accomplished.

Thus, the anodized surface layer formed using the anodizing solution of the invention is advantageously colored with an anodized aluminum-coloring dye. Examples of the dye include known acidic dyes, metal complex-containing dyes, and acidic mordant dyes. The conditions for coloring the anodized layer provided on the magnesium or magnesium-base alloy article concerning, for instance, concentration of the dye solution, pH of the dye solution, measure for preventing contamination of impurities, can be adjusted according to the conditions for performing colorization of general aluminum metal surface.

The colorization of the aluminum-containing surface layer formed on the article of magnesium or magnesium-base alloy by the use of the anodizing solution of the invention can be carried out in the conventional manner for coloring an aluminum article. For instance, a dye solution in which the dye content generally ranges from 1 to 10 g/l was first prepared, and if necessary, adjusted in the pH conditions. Further, a surfactant is optionally incorporated into the dye solution to give the desired dye solution for coloring the aluminum-containing layer. The details on other conditions and procedures for the coloring process are described in "Handbook of Metal Surface Treatment Technology" (in Japanese) editted by Society of Metal Surface Treating Technology (Nikkan Kogyo Shimbun-Sha, 1976) and "Handbook of Aluminum Surface Treatment Technology" (in Japanese) eddited by Society of Aluminum Surface Treating Technology (Keikinzoku Publishing, 1980).

As far as the temperature of a coloring solution is concerned, a temperature in the range of 55°–65° C. is generally adopted in the colorization of an aluminum surface. In contrast, the coloring procedure can be performed at a higher temperature such as approx. 100° C., for the aluminum-containing surface layer provided on the magnesium or magnesium-base alloy article, because the surface layer of an magnesium or magnesium-base alloy article produced through anodic oxidation using the anodizing solution of the invention is not sealed, such sealing being generally caused in contact with a boiling water in the treatment of aluminum metal surface. The high temperature coloring solution make it possible to color the surface layer formed using the anodizing solution of the invention within a shorter period, because the color-adsorption rate is accelerated.

The present invention is further described by the following examples.

In the following examples, the corrosion resistance was evaluated in accordance with the salt spray test described in JIS (Japanese Industrial Standard)-Z-2371, that is, by determining the corrosive weight loss of a test piece after having been subjected to salt spray for 16 hours. The abrasion resistance was evaluated in accordance with "Testing Method of Abrasion Resistance of Anodized Layer of Aluminum and Aluminum-base Alloy" described in JIS-H-8682, that is, by determining the number of double stroke frictional action (DS number) of the friction ring required for abrasively removing the surface layer of 1 μm thick out of the anodized surface layer in a surface abrasion test (load: 400 gf, number of the double stroke frictional action: 60 DS/min., roughness of abrasive paper: #320, abrasive material: SiC). The thickness of the produced surface layer was measured in accordance with the eddy current method described in JIS-H-8680 "Method for Measuring Anodized Layer on Aluminum and Aluminum-base Alloy Surface".

The condition on the colored surface of anodized layer was evaluated by visual observation on the colored surface after having been washed with water and dried, as well as by visual observation on decolorization of the colored surface after having been rubbed against a surface of a white paper sheet.

In the examples, a specimen (6 cm × 5 cm × 3 mm) cut out of the magnesium-base alloy sheet (AZ 31) was first treated by a #400 sand-paper and then subjected to an alkali cleaning process and an acid cleaning process. Thus treated specimen was immediately subjected to the anodic oxidation.

The following examples 1–11 and comparison examples 1–4 are given to describe the anodic oxidation or other known treatment for providing corrosion resistance.

EXAMPLES 1–9

One liter of an aqueous anodizing solution was prepared by dissolving in ion-exchanged water, sodium aluminate, sodium hydroxide and other additive(s) of the amounts set forth in Table 1 to make a 1-l aqueous solution. The specimen was anodized in the prepared anodizing solution under such conditions that the current density (alternating current) was 2 A/dm$^2$, the bath temperature was 25° C., and the anodizing period was 30 min.

TABLE 1

| | | |
|---|---|---|
| Example 1: | Sodium aluminate | 40 g. |
| | Sodium hydroxide | 100 g. |
| | Potassium methaborate | 35 g. |
| Example 2: | Sodium aluminate | 100 g. |
| | Sodium hydroxide | 120 g. |
| | Phenol | 10 ml |
| Example 3: | Sodium aluminate | 200 g. |
| | Sodium hydroxide | 120 g. |
| | Sodium sulfate | 10 g. |
| Example 4: | Sodium aluminate | 200 g. |
| | Sodium hydroxide | 120 g. |
| | Sodium iodide | 30 g. |
| Example 5: | Sodium aluminate | 40 g. |
| | Sodium hydroxide | 140 g. |
| | Potassium methaborate | 35 g. |
| | Potassium citrate | 10 g. |
| Example 6: | Sodium aluminate | 160 g. |
| | Sodium hydroxide | 120 g. |
| | Sodium iodide | 30 g. |
| | Potassium citrate | 25 g. |
| Example 7: | Sodium aluminate | 200 g. |
| | Sodium hydroxide | 120 g. |
| | Sodium iodide | 30 g. |
| | Phenol | 10 ml |
| Example 8: | Sodium aluminate | 200 g. |
| | Sodium hydroxide | 120 g. |
| | Potassium methaborate | 100 g. |
| | Sodium iodide | 30 g. |
| Example 9: | Sodium aluminate | 100 g. |
| | Sodium hydroxide | 100 g. |
| | Sodium iodide | 30 g. |
| | Potassium bichromate.2 hydrates | 10 g. |

EXAMPLE 10

The anodic oxidation of Example 6 was repeated using the anodizing solution of Example 6 and the aforementioned specimen, except that the current density was changed to 5 A/dm$^2$.

EXAMPLE 11

The anodic oxidation of Example 8 was repeated using the anodizing solution of Example 8 and the aforementioned specimen, except that the current density was changed to 5 A/dm$^2$.

COMPARISON EXAMPLE 1

An anodizing solution of the following formulation was prepared:

| | |
|---|---|
| Aluminum hydroxide | 35 g. |
| Potassium hydroxide | 165 g. |
| Potassium fluoride | 35 g. |
| Sodium phosphate | 35 g. |
| Potassium permanganate | 20 g. |
| Ion-exchanged water to make | 1 l. |

The anodic oxidation of Example 1 was repeated using the so prepared anodizing solution and the aforementioned specimen.

The present anodic oxidation was in accordance with the known HAE process. However, the present procedure comprised no surface-sealing treatment but simple washing with water after the anodic oxidation, so as to facilitate direct comparison with Examples 1–9.

COMPARISON EXAMPLE 2

An anodizing solution of the following formulation was prepared:

| | |
|---|---|
| Ammonium hydrofluoride | 240 g. |
| Sodium bichromate | 100 g. |
| 85% Phosphoric acid | 90 ml |
| Ion-exchanged water to make | 1 l. |

The anodic oxidation was carried out using the prepared anodizing solution and the aforementioned specimen under such conditions that the current density (alternating current) was 2.8 A/dm$^2$, the bath temperature was 76° C., and the anodizing period was 30 min.

The present anodic oxidation was in accordance with the known Dow-17 process. However, the present procedure comprised no surface-sealing treatment but simple washing with water after the anodic oxidation, so as to facilitate direct comparison with Examples 1–9.

COMPARISON EXAMPLE 3

A surface-treating solution of the following formulation was prepared:

| | |
|---|---|
| Sodium bichromate | 180 g. |
| 60% Nitric acid | 261 ml |
| Ion-exchanged water to make | 1 l. |

The aforementioned specimen was immersed in the prepared solution at 25° C. for 1 min., taken out of the solution, kept for 5 sec. to remove excessive aqueous drops therefrom, and washed with water.

The present treatment was done in accordance with the known process described in JIS-H-8651, Group 1-A.

COMPARISON EXAMPLE 4

A surface-treating solution of the following formulation was prepared:

| | |
|---|---|
| Sodium bichromate | 150 g. |
| 60% Nitric acid | 200 ml |
| Ion-exchanged water to make | 1 l. |

The aforementioned specimen was immersed in the so prepared solution at 35° C. for 1.5 min., taken out of the solution, kept for 5 sec. to remove excessive aqueous drops therefrom, and washed with water.

The present treatment was done in accordance with the known process described in JIS-H-8651, Group 1-B.

The thickness of the surface layer, corrosion resistance, abrasion resistance, and hue provided on the surface of the specimens upon treatments described in Examples 1–11 and Comparison Examples 1–4 are set forth in Table 2.

TABLE 2

| | Thickness of Formed Layer (μm) | Corrosive Weight Loss (g/m$^2$) | Abrasion Resistance (DS/μm) | Hue |
|---|---|---|---|---|
| Example | | | | |
| 1 | 5 | 0.6 | — | White |
| 2 | 6 | 0.9 | — | White |
| 3 | 7 | 0.9 | — | White |
| 4 | 24 | 0.6 | 20 | White |
| 5 | 4 | 0.4 | — | White |
| 6 | 14 | 0.7 | 22 | White |
| 7 | 11 | 1.0 | 31 | White |
| 8 | 25 | 0.3 | 21 | White |
| 9 | 24 | 0.0 | 15 | Pale Green |
| 10 | 21 | 0.1 | 25 | White |
| 11 | 40 | 0.1 | 26 | White |
| Comparison Example | | | | |
| 1 | 22 | 7.8 | 16 | Dark Brown |
| 2 | 34 | 2.8 | — | Dark Green |
| 3 | 2 | 44.6 | — | Yellow Red |
| 4 | 1 | 63.5 | — | Yellow Red |

The following examples 12–26 and comparison examples 5–9 are given to describe the processes for coloring the magnesium-alloy specimen and their results.

The dyes referred to in the following examples are specified in Table 3.

TABLE 3

| No. | Tradename of Dye | Classification | Manufacturer |
|---|---|---|---|
| 1 | Aluminium Red RLW | Azo-type non-metallic dye | Sandoz A.G. |
| 2 | Aluminium Blue 2LW | Anthraquinone-type non-metallic dye | Sandoz A.G. |
| 3 | Aluminium Violet CLW | Azo-type metal-complex dye | Sandoz A.G. |
| 4 | Aluminium Yellow G3LW | Azo-type metal-complex dye | Sandoz A.G. |
| 5 | Aluminium Green LWN | Azo-type metal-complex dye | Sandoz A.G. |
| 6 | Aluminium Grey NL Paste | Azo-type metal-complex dye | Sandoz A.G. |
| 7 | Alumalight Black 777 | Azo-type metal-complex dye | Kaname Shokai |
| 8 | Basalox Black SML | Azo-type metal-complex dye | Kaname Shokai |

EXAMPLE 12

The specimen anodized in the same manner as in Example 8 to have a white surface layer consisting essentially of spinel (thickness 25 μm) was immersed for 10 min. in aqueous solution containing the Dye No. 1 (2 g/l) kept at 60° C., and then washed with water for 10 min. The surface of the specimen was dried to show brilliant red color. This colored surface showed no noticeable change upon having been rubbed against a white paper sheet.

EXAMPLE 13

The specimen anodized in the same manner as in Example 8 to have a white surface layer consisting essentially of spinel (thickness 25 μm) was immersed for 10 min. in aqueous solution containing the Dye No. 2 (3 g/l) kept at 60° C., and then washed with water for 10 min. The surface of the specimen was dried to show brilliant blue color. This colored surface showed no noticeable change upon having been rubbed against a white paper sheet.

EXAMPLE 14

The specimen anodized in the same manner as in Example 8 to have a white surface layer consisting essentially of spinel (thickness 25 μm) was immersed for 10 min. in aqueous solution containing the Dye No. 3 (0.3 g/l) kept at 60° C., and then washed with water for 10 min. The surface of the specimen was dried to show brilliant violet color. This colored surface showed no noticeable change upon having been rubbed against a white paper sheet.

EXAMPLE 15

The specimen anodized in the same manner as in Example 8 to have a white surface layer consisting essentially of spinel (thickness 25 μm) was immersed for 10 min. in aqueous solution containing the Dye No. 4 (2.5 g/l) kept at 60° C., and then washed with water for 10 min. The surface of the specimen was dried to show brilliant yellow color. This colored surface showed no noticeable change upon having been rubbed against a white paper sheet.

EXAMPLE 16

The specimen anodized in the same manner as in Example 8 to have a white surface layer consisting essentially of spinel (thickness 25 μm) was immersed for 10 min. in aqueous solution containing the Dye No. 5 (2.5 g/l) kept at 60° C., and then washed with water for 10 min. The surface of the specimen was dried to show brilliant green color. This colored surface showed no noticeable change upon having been rubbed against a white paper sheet.

EXAMPLE 17

The specimen anodized in the same manner as in Example 8 to have a white surface layer consisting essentially of spinel (thickness 25 μm) was immersed for 10 min. in aqueous solution containing the Dye No. 6 (1 g/l) kept at 60° C., and then washed with water for 10 min. The surface of the specimen was dried to show clear gray color. This colored surface showed no noticeable change upon having been rubbed against a white paper sheet.

EXAMPLE 18

The coloring procedure described in Example 17 was repeated except that the temperature of the dyeing solution and the immersion period were changed to 100° C. and 5 min, respectively. The dried surface of the specimen showed real black. This black surface showed no noticeable change upon having been rubbed against a white paper sheet.

EXAMPLE 19

The specimen anodized in the same manner as in Example 8 to have a white surface layer consisting essentially of spinel (thickness 25 μm) was immersed for 10 min. in aqueous solution containing the Dye No. 7 (10 g/l) kept at 60° C., and then washed with water for 10 min. The surface of the specimen was dried to show clear gray color. This colored surface showed no noticeable change upon having been rubbed against a white paper sheet.

EXAMPLE 20

The specimen anodized in the same manner as in Example 8 to have a white surface layer consisting essentially of spinel (thickness 25 μm) was immersed for 10 min. in aqueous solution containing the Dye No. 8 (10 g/l) kept at 60° C., and then washed with water for 10 min. The surface of the specimen was dried to show clear gray color. This colored surface showed no noticeable change upon having been rubbed against a white paper sheet.

EXAMPLE 21

The specimen anodized in the same manner as in Example 2 to have a white surface layer consisting essentially of spinel (thickness 6 μm) was immersed for 10 min. in aqueous solution containing the Dye No. 1 (2 g/l) kept at 95° C., and then washed with water for 10 min. The surface of the specimen was dried to show brilliant red color. This colored surface showed no noticeable change upon having been rubbed against a white paper sheet.

EXAMPLE 22

The specimen anodized in the same manner as in Example 6 to have a white surface layer consisting essentially of spinel (thickness 14 μm) was immersed for 10 min. in aqueous solution containing the Dye No. 2 (1 g/l) kept at 95° C., and then washed with water for 10 min. The surface of the specimen was dried to show brilliant blue color. Theis colored surface showed no noticeable change upon having been rubbed against a white paper sheet.

EXAMPLE 23

The specimen anodized in the same manner as in Example 5 to have a white surface layer consisting essentially of spinel (thickness 4 μm) was immersed for 10 min. in aqueous solution containing the Dye No. 3 (0.5 g/l) kept at 95° C., and then washed with water for 10 min. The surface of the specimen was dried to show brilliant violet color. This colored surface showed no noticeable change upon having been rubbed against a white paper sheet.

EXAMPLE 24

The specimen was anodized in the same manner as in Example 1 except that the anodizing solution was changed to the solution of the following formulation:

| | |
|---|---|
| Sodium aluminate | 50 g. |
| Potassium hydroxide | 120 g. |
| Potassium fluoride | 35 g. |
| Potassium citrate | 50 g. |
| Ion-exchanged water to make | 1 l. |

The resulting specimen having a white surface layer consisting essentially of spinel (thickness 14 μm) was immersed for 10 min. in aqueous solution containing the Dye No. 4 (5 g/l) kept at 60° C., and then washed with water for 10 min. The surface of the specimen was dried to show brilliant yellow color. This colored surface showed no noticeable change upon having been rubbed against a white paper sheet.

EXAMPLE 25

The specimen anodized in the same manner as in Example 24 to have a white surface layer consisting essentially of spinel (thickness 8 μm) was immersed for 5 min. in aqueous solution containing the Dye No. 5 (2.5 g/l) kept at 90° C., and then washed with water for 10 min. The surface of the specimen was dried to show brilliant green color. This colored surface showed no noticeable change upon having been rubbed against a white paper sheet.

EXAMPLE 26

The specimen was anodized in the same manner as in Example 1 except that the temperature of the anodizing solution was changed to 60° C. and the formulation of the anodizing solution was changed to the following formulation:

| | |
|---|---|
| Sodium aluminate | 50 g. |
| Potassium hydroxide | 140 g. |
| Potassium fluoride | 35 g. |
| Potassium citrate | 50 g. |
| Potassium methaborate | 35 g. |
| Ion-exchanged water to make | 1 l. |

The resulting specimen having a white surface layer consisting essentially of spinel (thickness 14 μm) was immersed for 10 min. in aqueous solution containing the Dye No. 6 (5 g/l) kept at 60° C., and then washed with water for 10 min. The surface of the specimen was dried to show clear gray color. This colored surface showed no noticeable change upon having been rubbed against a white paper sheet.

COMPARISON EXAMPLE 5

A surface-treating solution for the known fluoride method haviang the following formulation was prepared:

| | |
|---|---|
| Ammonium fluoride | 100 g. |
| Ion-exchanged water to make | 1 l. |

The specimen was anodized in the prepared surface-treating solution under such conditions that the voltage (alternating current) was 120 V (constant), the bath temperature was 30° C., and the anodizing period was 20 min. The resulting surface layer was white and consisted essentially of $MgF_2$ (thickness 2 μm).

The specimen was then treated in the same manner as in Example 17 to show brilliant red color. This colored surface showed some drop-out of the dye upon having been rubbed against a white paper sheet.

COMPARISON EXAMPLE 6

An anodizing solution having the following formulation was prepared:

| | |
|---|---|
| Potassium hydroxide | 3 g. |
| Phenol | 5 ml |
| Surfactant | 1 ml |
| Ion-exchanged water to make | 1 l. |

The specimen was anodized in the prepared anodizing solution under such conditions that the current density (alternating current) was 2 A/dm$^2$, the bath temperature was 20° C., and the anodizing period was 90 min. The resulting surface layer was white and consisted essentially of $Mg(OH)_2$ (thickness 10 μm).

The specimen was then treated in the same manner as in Example 17 to show brilliant red color. This colored surface showed some drop-out of the dye upon having been rubbed against a white paper sheet.

COMPARISON EXAMPLE 7

An anodizing solution of the following formulation was prepared according to the aforementioned JIS Group 6:

| | |
|---|---|
| Sodium hydroxide | 240 g. |
| Ethylene glycol | 83 ml |
| Sodium oxalate | 25 g. |
| Ion-exchanged water to make | 1 l. |

The specimen was anodized in the prepared anodizing solution under such conditions that the current density (alternating current) was 1.5 A/dm$^2$, the bath temperature was 77° C., and the anodizing period was 20 min. The resulting surface layer was white and consisted essentially of $Mg(OH)_2$ (thickness 2 μm).

The specimen was then treated in the same manner as in Example 17 to show brilliant red color. This colored surface showed some drop-out of the dye upon having been rubbed against a white paper sheet.

COMPARISON EXAMPLE 8

An anodizing solution of the following formulation was prepared according to the aforementioned JIS Group 6:

| | |
|---|---|
| Sodium hydroxide | 40 g. |
| Potassium methaborate | 100 g. |
| Ion-exchanged water to make | 1 l. |

The specimen was anodized in the prepared anodizing solution under such conditions that the current density (alternating current) was 5 A/dm$^2$, the bath temperature was 25° C., and the anodizing period was 10 min. The resulting surface layer was white and consisted essentially of MgO (thickness 10 μm).

The specimen was then treated in the same manner as in Example 17 to show brilliant red color. This colored surface showed some drop-out of the dye upon having been rubbed against a white paper sheet.

COMPARISON EXAMPLE 9

An anodizing solution having the following formulation was prepared:

| | |
|---|---|
| Sodium hydroxide | 40 g. |
| Ion-exchanged water to make | 1 l. |

The specimen was anodized in the prepared anodizing solution under such conditions that the volatage (alternating current) was 40 V (constant), the bath temperature was 20° C., and the anodizing period was 30 min. The resulting surface layer was white and consisted essentially of MgO (thickness 2 μm).

The specimen was then treated in the same manner as in Example 17 to show brilliant red color. This colored surface showed some drop-out of the dye upon having been rubbed against a white paper sheet.

EXAMPLE 27

The specimens colored in Examples 12–16, as well as the corresponding non-colored specimens (i.e., simply anodized), were subjected to corrosion test by the salt spray method described in JIS-Z-2371. It was noted that the colored specimens favorably showed corrosive weight loss half as much as the corresponding non-colored specimens. Accordingly, it has been confirmed that the coloring treatment applied to the specimens anodized in the anodizing solution of the invention is effective not only for producing an ornamentally satisfactory good but also for improving the corrosion resistance.

We claim:

1. An aqueous anodizing solution for anodizing an article of magnesium or magnesium-base alloy which contains, per one liter volume thereof, 20–300 g. of an aluminate, 1–8 moles of an alkali hydroxide per one mole of the aluminate, and at least one kind selected from the group consisting of 20–200 g. of a boron compound, 2–50 ml. of a phenol, 2–50 g. of a sulfate, and 5–70 g. of an iodine compound.

2. The aqueous anodizing solution as claimed in claim 1, containing, per one liter volume thereof, 20–300 g. of an aluminate, 1–8 moles of an alkali hydroxide per one mole of the aluminate, 20–200 g. of a boron compound, and 5–70 g. of an iodine compound.

3. The aqueous anodizing solution as claimed in claim 1, which additionally contains 2–100 g. of a chromate per one liter volume thereof.

4. The aqueous anodizing solution as claimed in claim 1, containing, per one litter volume thereof, 20–300 g. of an aluminate, 1–8 moles of an alkali hydroxide per one mole of the aluminate, 5–70 g. of an iodine compound, and at least one kind selected from the group consisting of 20–200 g. of a boron compound, 2–50 ml of a phenol, and 2–50 g. of a sulfate.

5. A process for coloring an article of magnesium or magnesium-base alloy which comprises anodizing a surface of said article by contacting said surface with an aqueous anodizing solution as defined in claim 1 to form an aluminum oxide-containing spinel layer over said surface and coloring said spinel layer with an anodized aluminum-coloring dye whereby said dye is fixed in and colors and spinel layer.

6. The process for coloring an article of magnesium or nagnesium-base alloy as claimed in claim 5 wherein said spinel layer has the general formula $MgO.Al_2O_3$ and wherein said spinel layer is colored by applying a solution containing said dye to said spinel layer.

7. The process for coloring an article of magnesium or magnesium-base alloy as claimed in claim 5, in which said anodizing solution contains, at least one kind selected from the group consisting of 20–200 g. of a boron compound, and 5–70 g. of an iodine compound.

8. The process for coloring an article of magnesium or magnesium-base alloy as claimed in claim 5 in which said aqueous anodizing solution contains, per one liter volume thereof, 20–300 g. of an aluminate, 0.1–6 moles of an alkali hydroxide per one mole of the aluminate, and at least one kind selected from the group consisting of 20–200 g. of a boron compound, and 5–70 g. of an iodine compound.

9. The aqueous anodizing solution as claimed in claim 2, which additionally contains 2–100 g. of a chromate per one liter volume thereof.

* * * * *